US008784163B2

(12) United States Patent
Rogers

(10) Patent No.: US 8,784,163 B2
(45) Date of Patent: Jul. 22, 2014

(54) SANDING APPARATUS

(75) Inventor: Mark Graham Rogers, Watford (GB)

(73) Assignee: Hire Technicians Group Ltd., Hertfordshire (GB)

( * ) Notice: Subject to any disclaimer, the term of this patent is extended or adjusted under 35 U.S.C. 154(b) by 417 days.

(21) Appl. No.: 13/061,619

(22) PCT Filed: Aug. 20, 2009

(86) PCT No.: PCT/GB2009/002053

§ 371 (c)(1),
(2), (4) Date: May 11, 2011

(87) PCT Pub. No.: WO2010/023436

PCT Pub. Date: Mar. 4, 2010

(65) Prior Publication Data

US 2011/0207387 A1 Aug. 25, 2011

(30) Foreign Application Priority Data

Sep. 1, 2008 (GB) ..... 0815856

(51) Int. Cl.
*B24B 23/00* (2006.01)

(52) U.S. Cl.
USPC ..... 451/358; 451/504; 451/506

(58) Field of Classification Search
USPC ..... 451/358, 504, 506, 514, 515, 516
See application file for complete search history.

(56) References Cited

U.S. PATENT DOCUMENTS

| | | | | | |
|---|---|---|---|---|---|
| 2,483,422 | A | | 10/1949 | Larson | |
| 2,548,166 | A | | 4/1951 | Larson | |
| 2,709,879 | A | | 6/1955 | Larson | |
| 3,597,883 | A | * | 8/1971 | Choplin et al. | 451/358 |
| 4,018,014 | A | * | 4/1977 | Belanger | 451/469 |
| 4,291,507 | A | * | 9/1981 | Littlehorn, Jr. | 451/506 |
| 4,546,576 | A | * | 10/1985 | Dreiling | 451/504 |
| 5,707,279 | A | * | 1/1998 | Mitchell et al. | 451/512 |
| 6,086,466 | A | * | 7/2000 | Tasin et al. | 451/495 |
| 2006/0046629 | A1 | * | 3/2006 | Bobst | 451/533 |

FOREIGN PATENT DOCUMENTS

| | | |
|---|---|---|
| CA | 2202981 | 4/1996 |
| GB | 2417705 A | 3/2006 |

OTHER PUBLICATIONS

UK Search Report for GB0815856.0, Oct. 15, 2008, 3 pages.

* cited by examiner

*Primary Examiner* — Robert Rose
(74) *Attorney, Agent, or Firm* — Withrow & Terranova, PLLC

(57) ABSTRACT

Sanding apparatus comprises a rigid non-expanding cylindrical sanding drum (1) formed with splines on its outer surface (4) and a separate cylindrical cover (2) formed of elastomeric material fitted removably onto the drum and formed with splines on its inner surface (8) adapted to engage with the outer surface of the drum so as to be driven in rotation therewith. An abrasive tube (3) fits over the cover (2) and is gripped by the cover which expands radially when the apparatus is in operation.

20 Claims, 9 Drawing Sheets

SANDING APPARATUS

This application is a 35 U.S.C. §371 National Phase of PCT/GB2009/002053, filed Aug. 20, 2009, which claims priority to United Kingdom Patent Application No. 0815856.0, filed Sep. 1, 2008, both of which are incorporated by reference in their entireties.

The invention relates to sanding apparatus of the kind that use a drum to drive an abrasive sheet or tube. One use is on floor sanding machines, but the invention is applicable to any rotating drum type sanding machine.

Traditionally drum type sanding machines use a solid drum with a soft covering permanently fixed to the outer surface either by bonding into position or by fixing with adhesive. This soft material, typically a layer of rubber having a thickness of about 1 to 2 cm vulcanised onto an aluminium drum, provides cushioning and drive to the abrasive sheets or tubes. An abrasive sheet or an abrasive tube is fitted over the soft cover and the drum is rotated by a motor to provide the sanding action. In a first type of these machines, a sheet of abrasive material is wrapped around the soft covering with its ends either tucked into a slot or covered by a plate to hold the sheet firmly against the drum cover. Fitting of the sheet by inexperienced users of the machines (such as occurs in the machine hire sector) led to problems in the past and so a second type of machine was developed in which the abrasive sheet is supplied as a pre-formed tube which is simply slipped over the drum cover. In this machine the drum cover expands during rotation of the drum to grip the abrasive tube and is formed with angled slots in the outer surface which open out by centrifugal force when the drum is rotated so that the outer diameter of the cover is increased. This grips the inside of the abrasive tube and provides the drive to the abrasive tube to obtain the sanding function.

One major problem with these traditional drum covers is that the soft covering permanently fixed to the drum soon deteriorates and is easily damaged, such as by protruding nails, resulting in poor drive and finish. To repair the traditional drum the complete drum must be sent away to a specialist to have the old cover stripped off and a new cover moulded or stuck onto it, after which it must be very carefully machined and balanced since the machines operate at very high rotation speeds. This is a time consuming and costly exercise causing the machine to be out of use for considerable periods.

U.S. Pat. No. 4,546,576 discloses polishing apparatus in which a resilient sleeve is located on an expandable slotted hub and an abrasive band is located on the outside of the resilient sleeve. The hub is expanded by adjustment of a tapered mandrel housed within the tapered interior of the expandable hub. Expansion of the hub causes the resilient sleeve to expand and grip the abrasive band. The hub and sleeve of this apparatus are complicated and expensive to manufacture and assemble.

U.S. Pat. No. 2,709,879 discloses an abrasive sleeve holder in which an abrasive sleeve or band is supported on a cylindrical rubber rim which is connected, through a plurality of circumferentially spaced rubber tubes and a plurality of circumferentially spaced rubber arms, to a solid central hub. The inner ends of the arms are anchored to the central hub by means of a plurality of circumferentially spaced keyhole slots in the hub. In this device, the elastomeric sleeve holder is a very complicated moulding which cannot be easily and quickly replaced on the hub if damaged. Similar devices are disclosed in U.S. Pat. Nos. 2,483,422 and 2,548,166.

The invention proposes a rigid, non-expandable drum that will drive a completely separate soft cover of simple construction that is not permanently fixed or otherwise tethered to the solid drum but driven in rotation therewith by engaging teeth or splines. This cover does not need additional machining or balancing. Replacement of the cover is simply achieved by sliding the old cover off the drum and sliding a new cover on. The drum does not need to be sent away as the user can easily replace the cover, making huge savings in cost and downtime.

The invention provides sanding apparatus comprising a rigid cylindrical sanding drum formed with a splined outer surface and a cylindrical cover formed of elastomeric material fitted removably onto the drum and formed with splined inner surface adapted to engage with the outer surface of the drum so as to be driven in rotation therewith; wherein the cover is not fixed or tethered to the drum but free to move radially away from the drum during rotation of the apparatus.

The cover is free to move radially outwardly away from the drum during rotation to grip and drive an abrasive sheet or tube. The expanding action is provided by the soft cover expanding due to centrifugal force when the drum rotates. The soft cover is not fixed or otherwise tethered to the solid drum and is free to expand radially away from the solid drum to grip and drive the abrasive tube. The cover continues to be driven by remaining in mesh with the teeth or splines. Enhanced drive of the abrasive tube can be achieved by the use of angled surfaces between the solid drum and the cover that provide a wedge effect when under load. The expanding action of this cover is only limited by the inner diameter of the abrasive tube.

The inner surface of the cover will match the outer surface of the drum having teeth or splines to take the drive from the solid drum. The outer surface of the cover can be plain, grooved or patterned to provide extra grip on the inside of the abrasive tube. The soft cover can consist of one or more separate cylindrical sections and may contain a method of limiting the amount that the cover can expand when an abrasive tube is not fitted, rotating free.

Embodiments of the invention are described below with reference to the accompanying drawings, in which.

A sanding drum 1, cover 2 and abrasive tube 3 shown in the accompanying drawings form an assembly which is journalled for rotation in a sanding machine (not shown). In known manner such machines comprise a frame supported on ground engaging wheels and/or rollers. A motor mounted on the frame drives the drum in rotation about its axis which is horizontally mounted on a stub axle. A handle with hand controls is provided for steering the machine across a floor to be sanded. Since the drum is mounted on a stub axle, it can be easily exposed for replacement of the cover.

Figure 1:
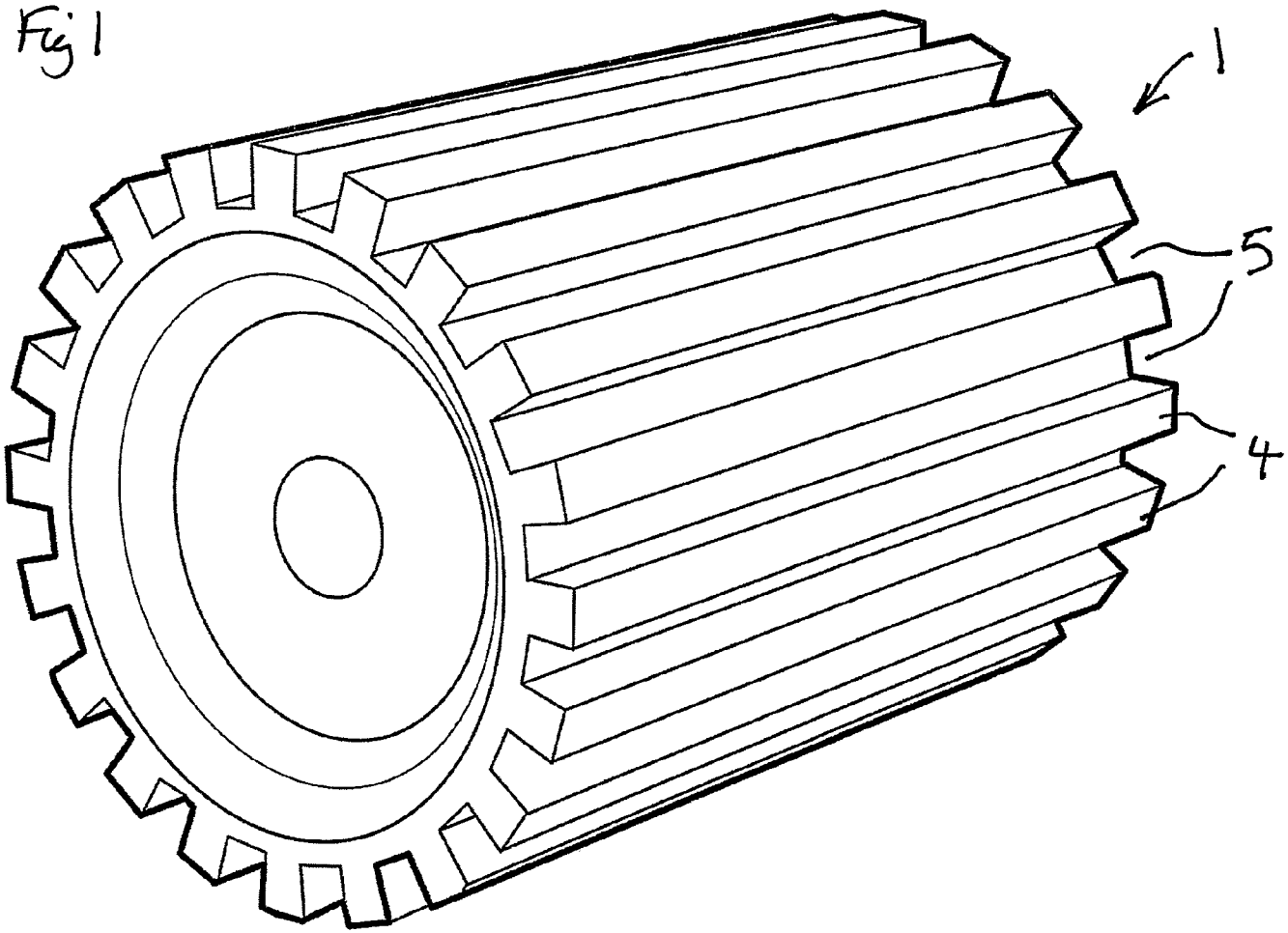
FIG. 1 is a perspective view of a sanding drum.

As shown in FIG. 1, a first embodiment of the cylindrical sanding drum 1 has a plurality of rectangular axially extending splines 4 machined thereon. The splines are evenly distributed around the circumference of the drum and are separated by valleys 5 of substantially equal dimensions. The valleys and splines have a substantially rectangular profile with radially extending sides. The drum is adapted internally for being rotationally mounted on an axle.

Figure 2:
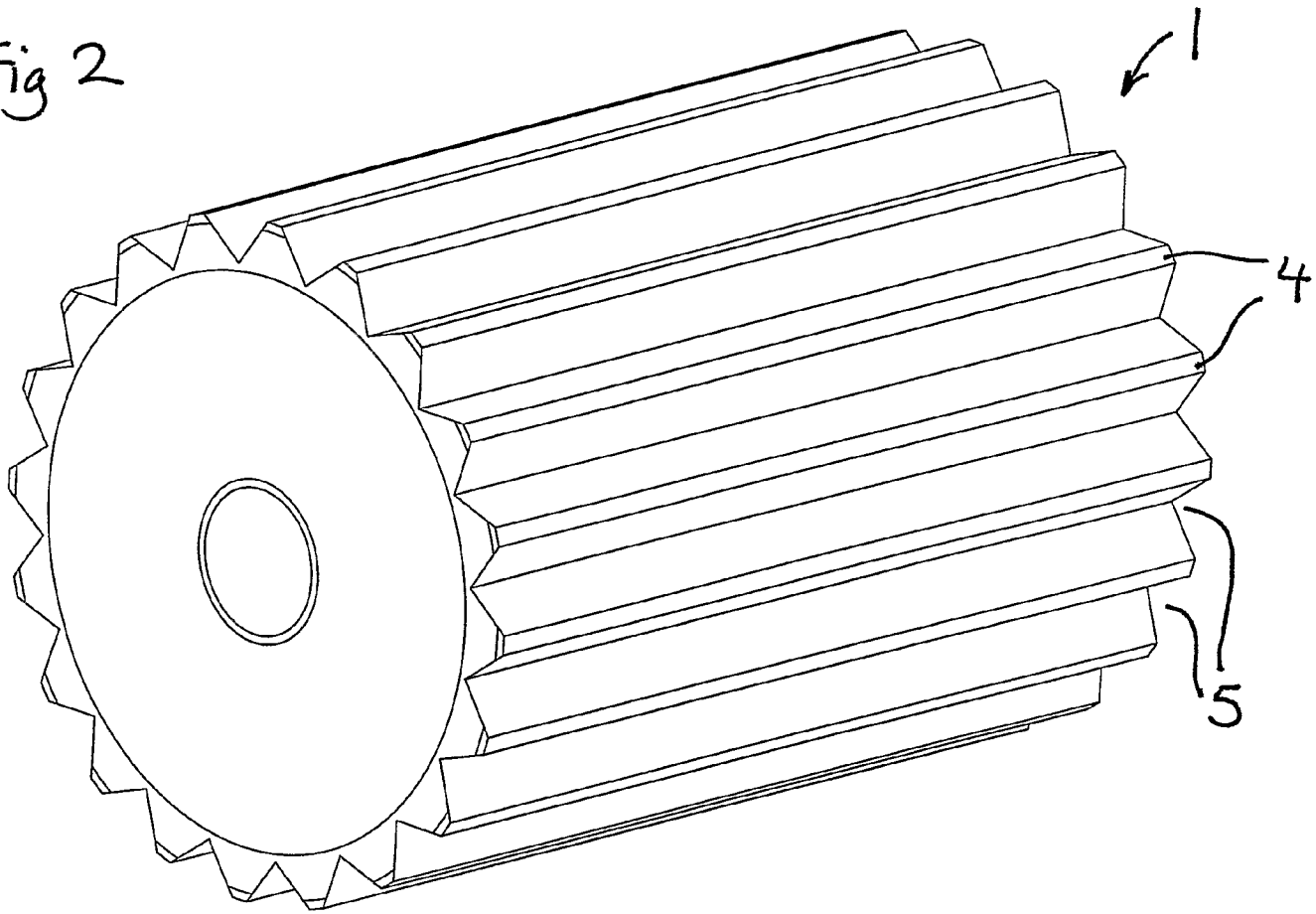
FIG. 2 is a perspective view of a second sanding drum.

A second embodiment of cylindrical sanding drum 1 is shown in FIG. 2 and differs only in that the splines 4 have a triangular or saw-toothed profile. As shown, the splines are rotationally symmetrical but rotationally asymmetrical saw-toothed splines can be used.

The drum can be made from any strong material such as plastic, steel or aluminium alloy. The drum is of a rigid non-expanding construction of fixed dimensions.

Figure 3:
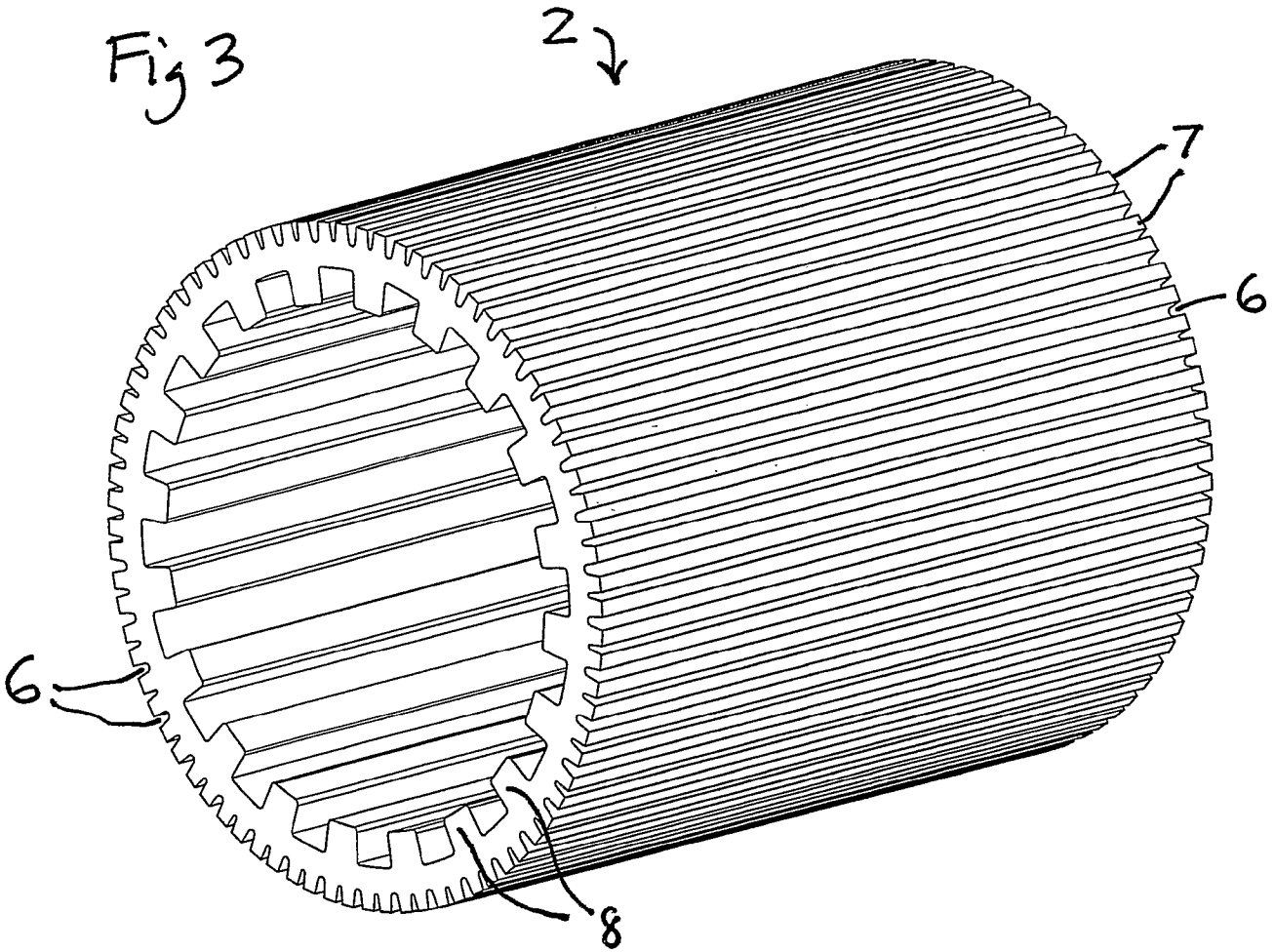
FIG. 3 is a perspective view of a cover for the sanding drum of FIG. 1.
Figure 4:
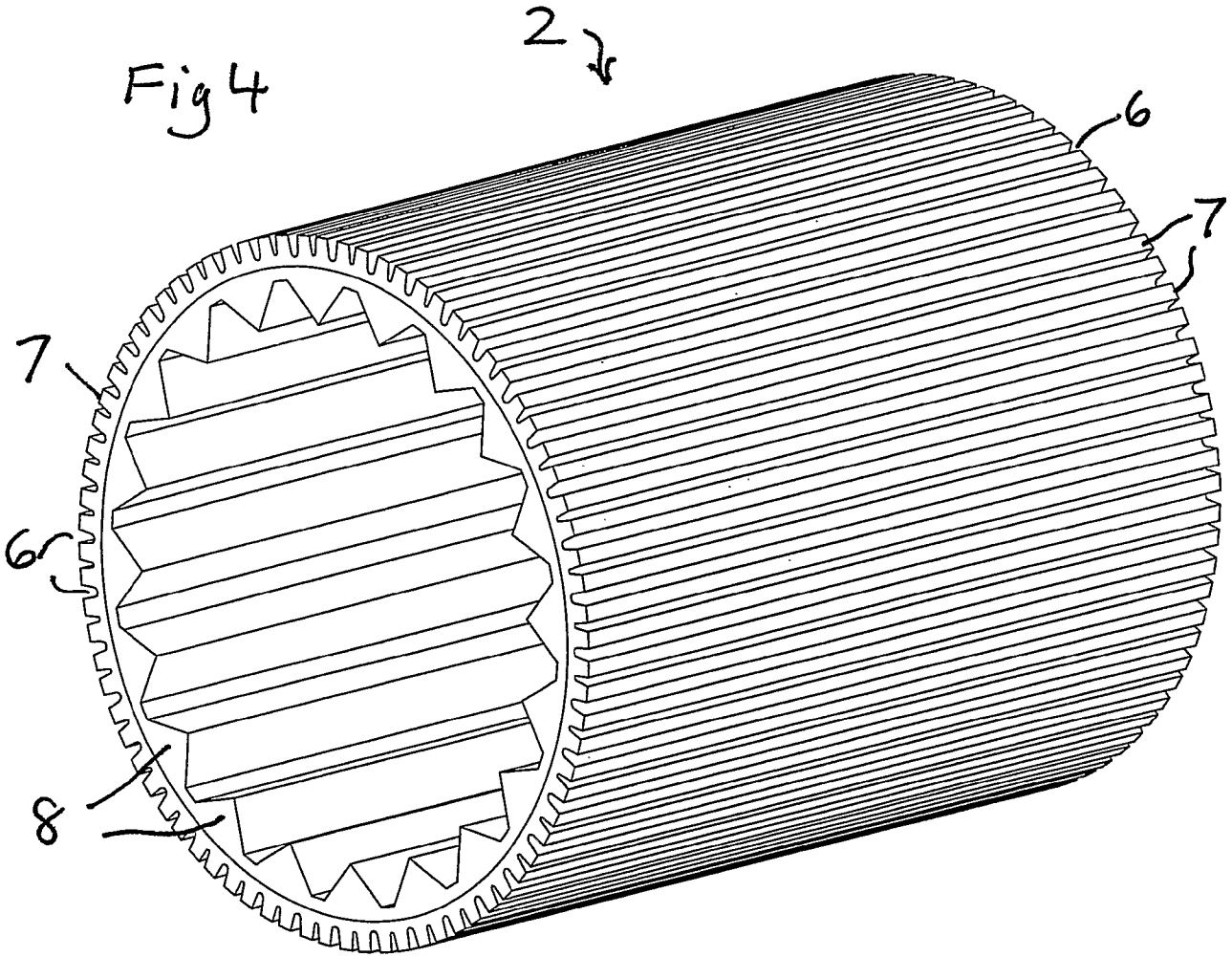
FIG. 4 is a perspective view of a cover for the sanding drum of FIG. 2.

FIGS. 3 and 4 show elastomeric covers 2 in the form of sleeves adapted to be fitted onto the drums of FIGS. 1 and 2. The covers have splined inner surfaces corresponding to the splined outer surfaces of the drums. The covers can slide axially on the drums for fitting and removal with a close but not tight fit with the splines 8 of the covers meshing with the splines 4 of the drums.

The outer surfaces of the covers are formed with spaced axially extending radial grooves 6 defining axially extending radial ribs 7 therebetween. This feature is believed to assist in gripping of the abrasive tube and expansion of the cover as described below. In another embodiment (not shown) the grooves and ribs are omitted and the outer surface is smooth.

The covers can be made of any suitable elastomeric material such as rubber, rubber compound or soft plastic and can be reinforced if required. In embodiments in which the covers are rotationally symmetrical, it does not matter which way round they are fitted to the drum. Suitable cover material will be in the Shore hardness (durometer) range of 30 to 70, preferably about 40.

Suitably, the covers are made by compression moulding or injection moulding. Such manufacturing processes provide accurate dimensioning of the cover. This is important since the machines operate at very high rotation speeds and must be well balanced to avoid vibration and/or chatter. The covers have a simple construction and do not have any hollows running through them.

Whilst the splines 4 and valleys 5 of the drums have been shown as having equal dimension, it would be equally possible for other arrangements to be used with corresponding changes to the splines 8 in the covers. Equally the number of splines provided can be varied. The preferred number of splines is in the range of 16 to 24 with 20 splines being most preferred.

Figure 5:
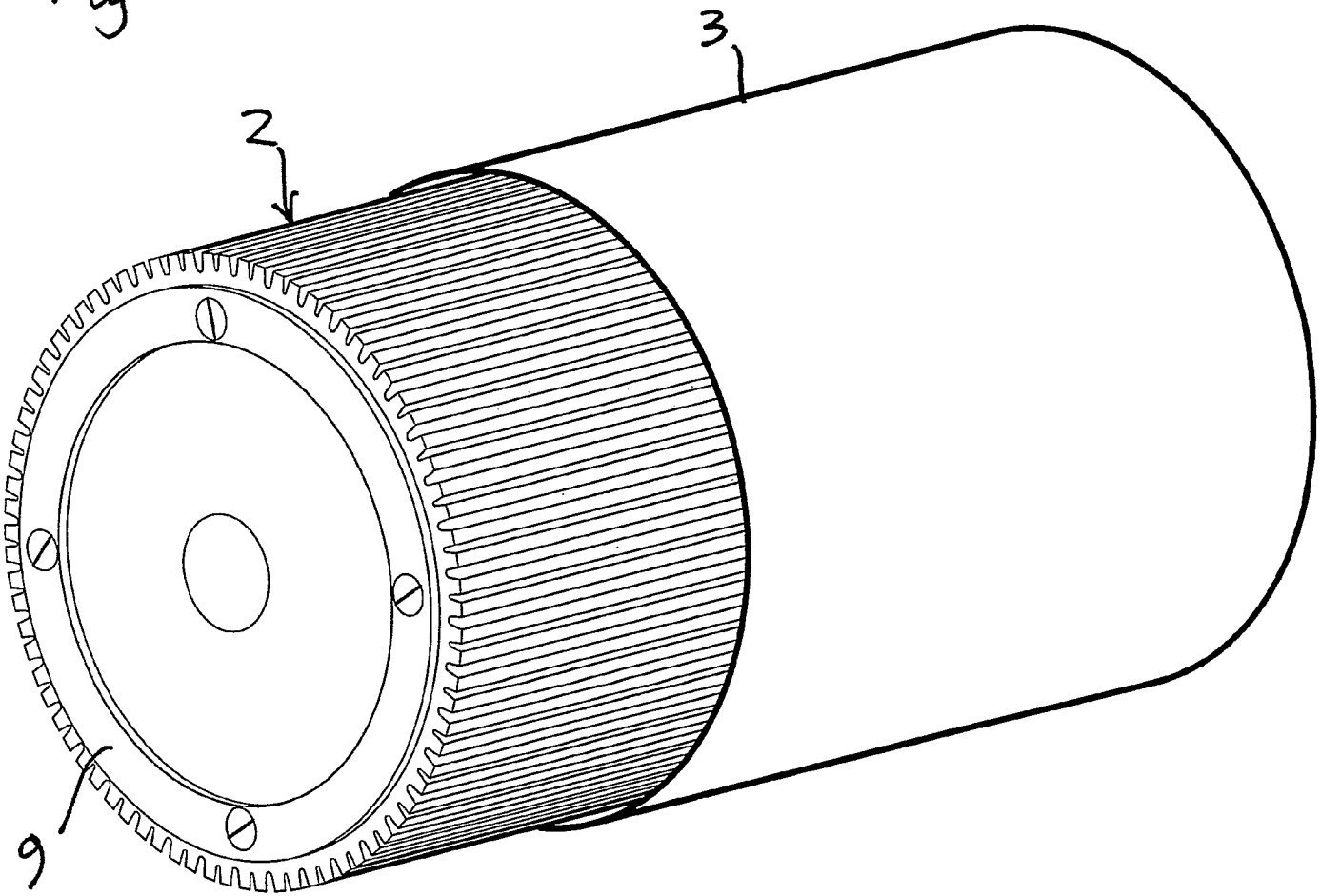
FIG. 5 is a perspective view of the drum of FIG. 1 with the cover of FIG. 3 and with an abrasive tube part assembled.

FIG. 5 shows an assembly of a drum and cover with an abrasive tube shown half on the cover. A locking ring 9 has been fitted to the drum to hold the cover axially in place. A similar locking ring is provided at the other end (not shown) of the drum. The end faces of the cover are recessed to accommodate these rings.

The abrasive tube 3 is of known type and comprises a sheet of abrasive material joined end to end to form a cylinder. The outer dimension of the cover is such that the tube can slide over it relatively easily.

Figure 6:
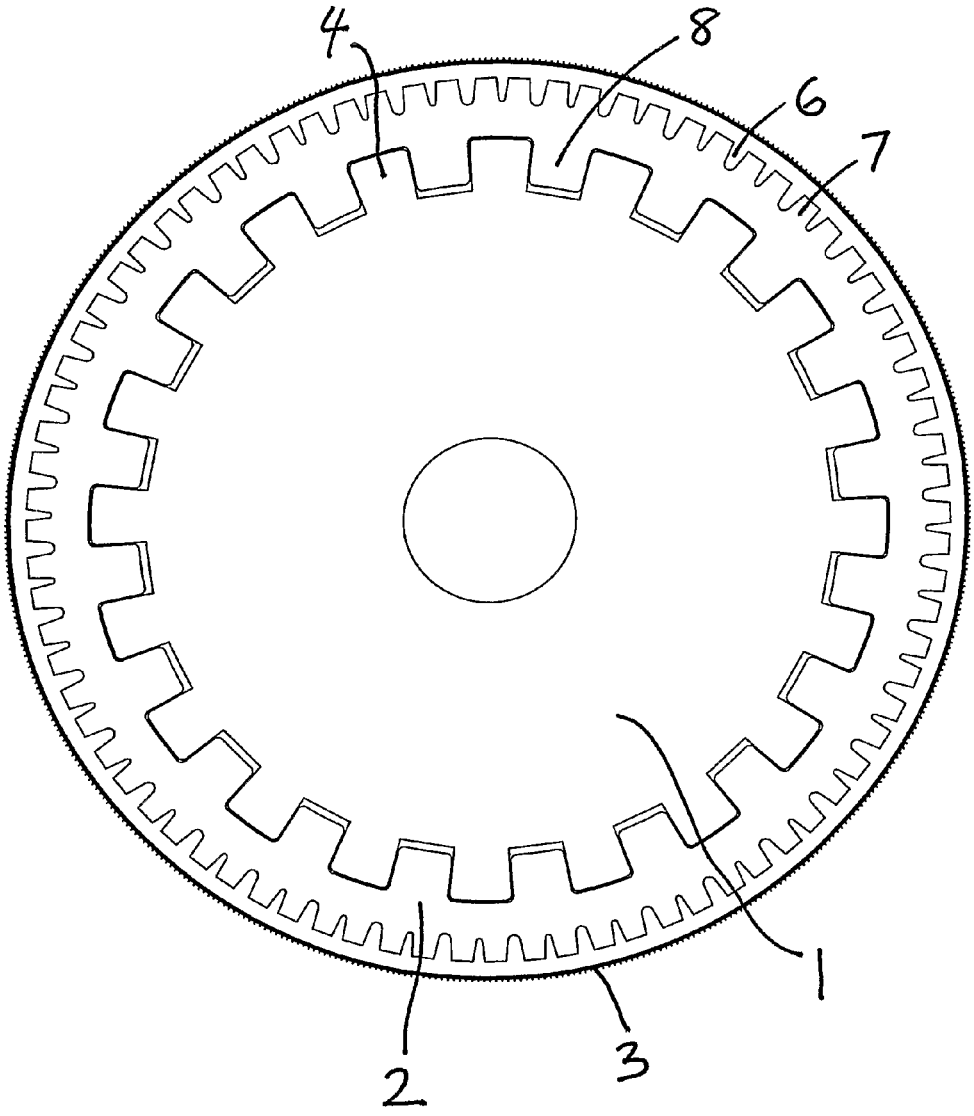
FIG. 6 is an end view of a drum cover and tube assembly in the static condition.
Figure 8:
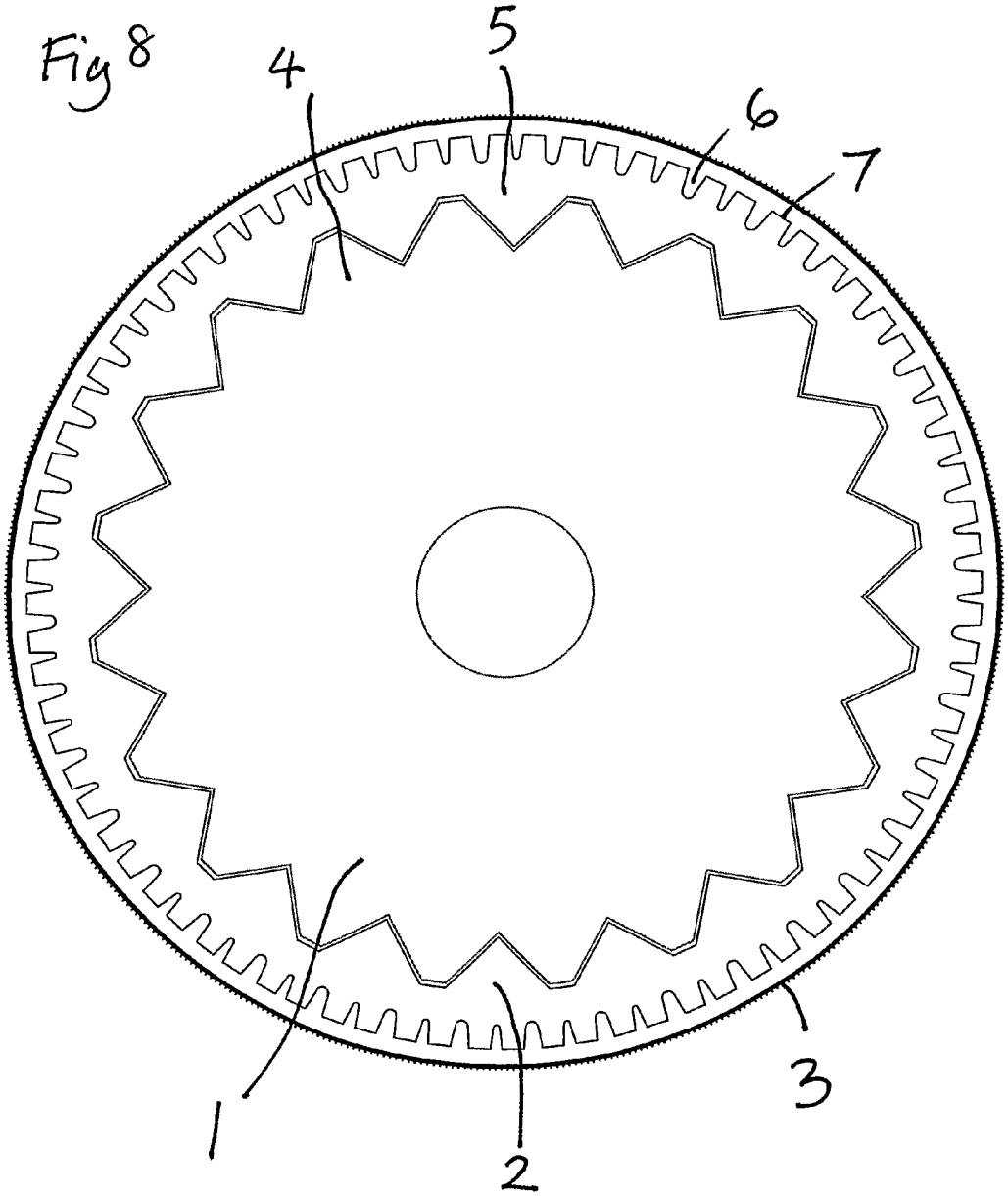
FIG. 8 is an end view of a drum cover and tube assembly in the static condition.

FIGS. 6 and 8 are end views of the drum, cover and tube assemblies in the static condition. The cover 2 is a close fit on the outside of the drum 1 with the splines 8 on the cover meshing with the splines 4 of the drum. The abrasive tube 3 is loosely mounted on the outside of the cover. As shown, the gap between the cover and the tube has been slightly exaggerated.

Figure 7:
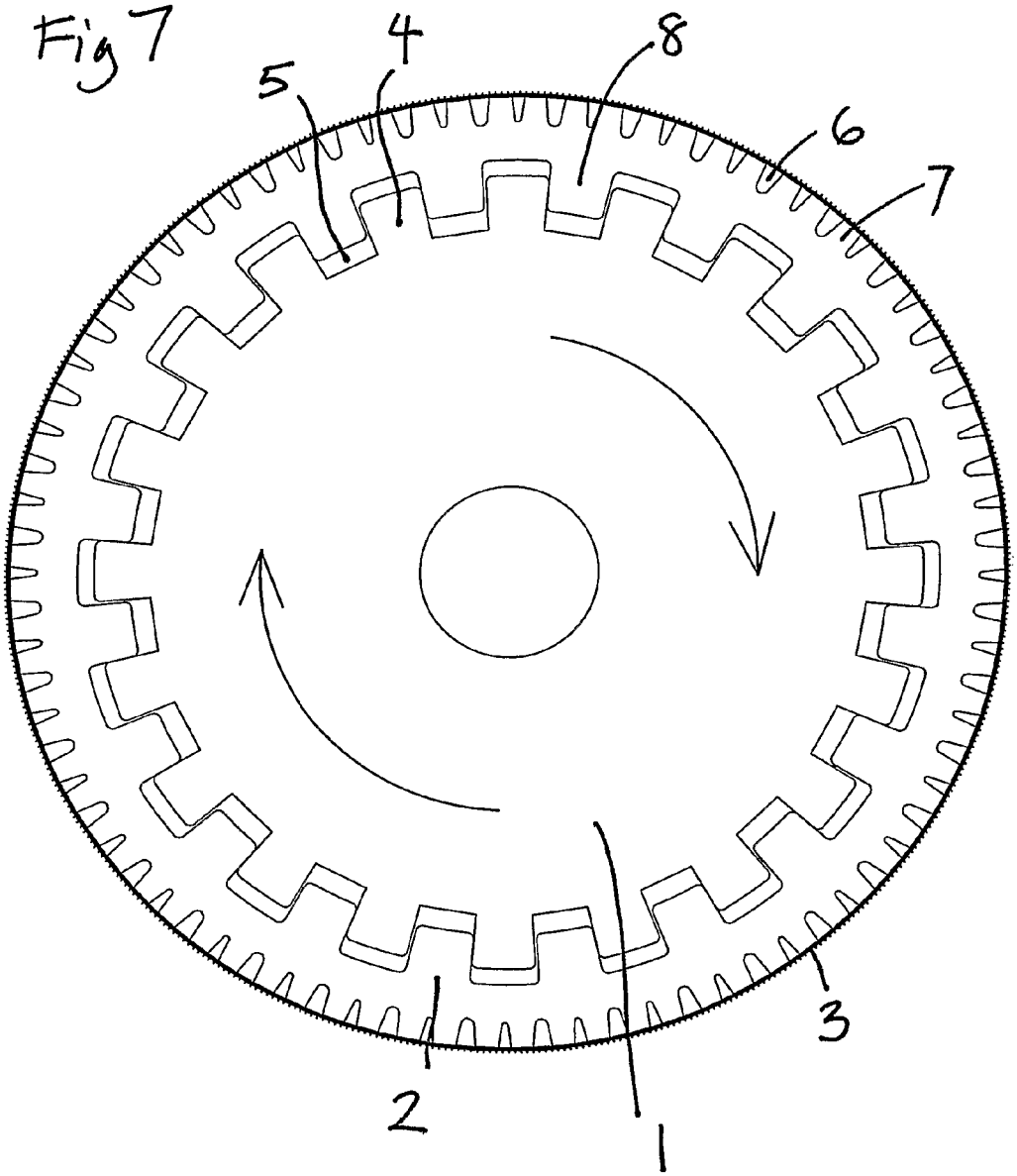
FIG. 7 is an end view of the assembly of FIG. 6 in the dynamic (rotating) condition.
Figure 9:
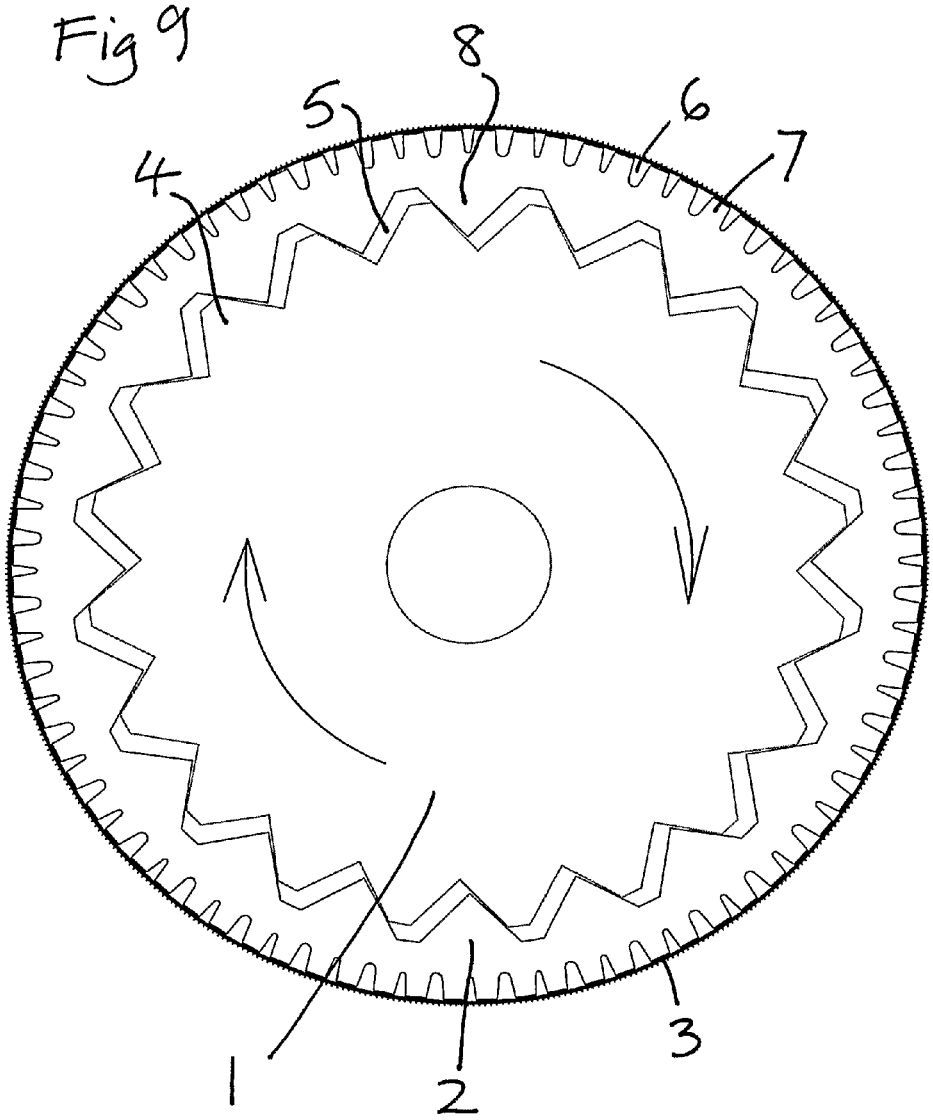
FIG. 9 is an end view of the assembly of FIG. 8 in the dynamic (rotating) condition.

FIGS. 7 and 9 show end views of the assemblies in the dynamic (rotating condition). In this condition, the resilient cover expands radially through centrifugal force. The spline profile is such that the cover is driven in rotation but is radially unrestrained. As a result, it is free to move radially away from the drum during rotation as shown in FIGS. 7 and 9. The saw-toothed profile of the splines 4 and 8 in FIGS. 8 and 9 provides a wedging effect which assists in this but is not essential. The ribbed outer surface of the expanded cover 2 bears against the inside of the abrasive tube 3 and grips it strongly to drive it in rotation.

In traditional expanding type sanders, it has been found that a certain amount of rotational creep occurs between the rubber cover and the abrasive tube in use. Tests have shown that this creep is substantially reduced or eliminated in the present invention.

The nominal thickness of the cover of the present invention may be similar to that of traditional expanding covers but, because of the splined inner profile, the volume of material is reduced.

The invention claimed is:

1. A sanding apparatus comprising a rigid non-expandible cylindrical sanding drum of fixed dimensions formed with a splined outer surface and a separate cylindrical cover formed of elastomeric material fitted removably onto the drum and formed with a splined inner surface adapted to engage with the outer surface of the drum so as to be driven in rotation therewith; wherein the cover is not fixed or tethered to the drum but free to move radially away from the drum during rotation of the apparatus; wherein the apparatus further comprises a cylindrical abrasive sanding tube adapted to be loosely mounted over the cylindrical cover in the static condition such that radial expansion of the cover during rotation of the apparatus causes the cover to grip the abrasive tube and drive it in rotation.

2. The sanding apparatus as claimed in claim 1, wherein the splines of the drum and the cover have a generally stepped profile.

3. The sanding apparatus as claimed in claim 1, wherein the splines of the drum and the cover have a generally triangular or saw-toothed profile.

4. The sanding apparatus as claimed in claim 1, wherein the outer surface of the cover is formed with spaced axially extending radial grooves defining axially extending radial ribs therebetween.

5. The sanding apparatus as claimed in claim 1, wherein the outer surface of the cover is smooth.

6. The sanding apparatus as claimed in claim 1, wherein the cover is rotationally symmetrical about its axis.

7. The sanding apparatus as claimed in claim 1, wherein the cover is formed in two separate cylindrical sections.

8. The sanding apparatus as claimed in claim 2, wherein the cover is rotationally symmetrical about its axis.

9. The sanding apparatus as claimed in claim 3, wherein the cover is rotationally symmetrical about its axis.

10. The sanding apparatus as claimed in claim 4, wherein the cover is rotationally symmetrical about its axis.

11. The sanding apparatus as claimed in claim 5, wherein the cover is rotationally symmetrical about its axis.

12. The sanding apparatus as claimed in claim 2, wherein the cover is formed in two separate cylindrical sections.

13. The sanding apparatus as claimed in claim 3, wherein the cover is formed in two separate cylindrical sections.

14. The sanding apparatus as claimed in claim 4, wherein the cover is formed in two separate cylindrical sections.

15. The sanding apparatus as claimed in claim 5, wherein the cover is formed in two separate cylindrical sections.

16. The sanding apparatus as claimed in claim 6, wherein the cover is formed in two separate cylindrical sections.

17. The sanding apparatus as claimed in claim 8, wherein the cover is formed in two separate cylindrical sections.

18. The sanding apparatus as claimed in claim 9, wherein the cover is formed in two separate cylindrical sections.

19. The sanding apparatus as claimed in claim 10, wherein the cover is formed in two separate cylindrical sections.

20. The sanding apparatus as claimed in claim 11, wherein the cover is formed in two separate cylindrical sections.

* * * * *